United States Patent [19]

Korenberg

[11] Patent Number: 5,029,557

[45] Date of Patent: Jul. 9, 1991

[54] CYCLONE COMBUSTION APPARATUS

[75] Inventor: Jacob Korenberg, York, Pa.

[73] Assignee: Donlee Technologies, Inc., York, Pa.

[21] Appl. No.: 305,197

[22] Filed: Feb. 2, 1989

Related U.S. Application Data

[63] Continuation-in-part of Ser. No. 44,735, May 1, 1987, Pat. No. 4,860,695.

[51] Int. Cl.[5] ..... F22B 7/12; F23C 5/08

[52] U.S. Cl. ..... 122/149; 122/136 R; 122/153; 110/234; 110/264; 431/181; 431/183; 431/187

[58] Field of Search ..... 122/367, 4 D, 149, 136 R, 122/153; 110/245, 233, 234, 264; 431/9, 10, 181, 182, 183, 185, 278, 285, 350, 353, 354, 187

[56] References Cited

U.S. PATENT DOCUMENTS

| | | | |
|---|---|---|---|
| 3,329,131 | 12/1964 | Wright | 431/185 X |
| 3,368,605 | 2/1966 | Reed | 431/284 X |
| 4,377,119 | 3/1983 | Noack | 122/4 D X |
| 4,394,118 | 7/1983 | Martin | 431/4 |
| 4,395,223 | 7/1983 | Okigami et al. | 431/10 |
| 4,475,472 | 10/1984 | Adrian et al. | 122/4 D X |
| 4,624,191 | 11/1986 | Zauderer et al. | 110/264 |

FOREIGN PATENT DOCUMENTS

| | | | |
|---|---|---|---|
| 2151344A | 7/1985 | United Kingdom | 110/234 |

*Primary Examiner*—Henry A. Bennet
*Assistant Examiner*—C. Kilner
*Attorney, Agent, or Firm*—Finnegan, Henderson, Farabow, Garrett & Dunner

[57] ABSTRACT

A cyclone combustion apparatus includes a combustion chamber having a substantially cylindrical wall, a substantially cylindrical exit throat at the rear end of the combustion chamber, means for supplying fuel into the combustion chamber at a front end thereof, means for supplying air into the combustion chamber and for forming a cyclonic flow pattern of hot gases for combustion within the chamber, and heat exchange means surrounding and extending throughout the axial length of the combustion chamber. The means for supplying air includes a plenum chamber having an air inlet and an annular air supply opening in communication with and coaxial with the combustion chamber. The annular air supply opening has spaced radial vanes tilted at a selected angle from the axis of the combustion chamber. The means for supplying fuel includes a fuel plenum chamber having a fuel inlet and a plurality of radially spaced fuel holes for supplying fuel in the annular air supply opening between the spaced radial vanes. Preferably, means are provided for supplying steam into the fuel plenum chamber for reducing the formation of $NO_x$ during combustion.

28 Claims, 7 Drawing Sheets

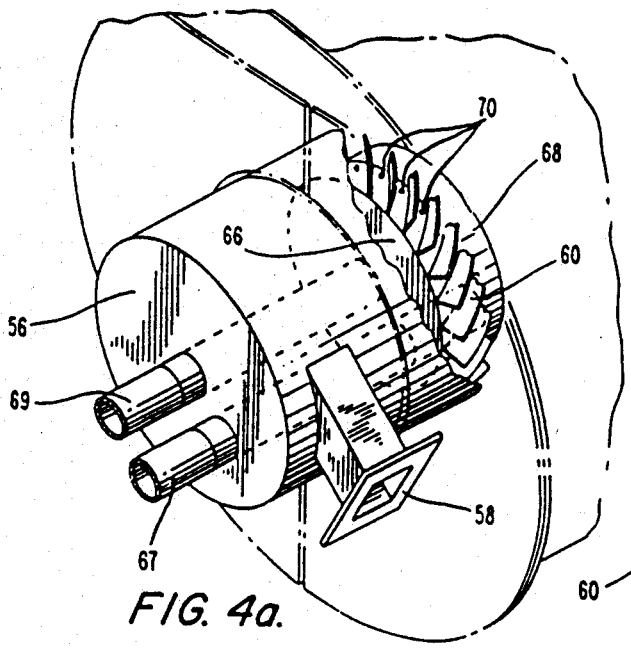
FIG. 4a.
FIG. 4d.
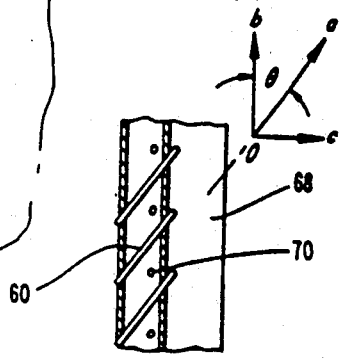
FIG. 4c.
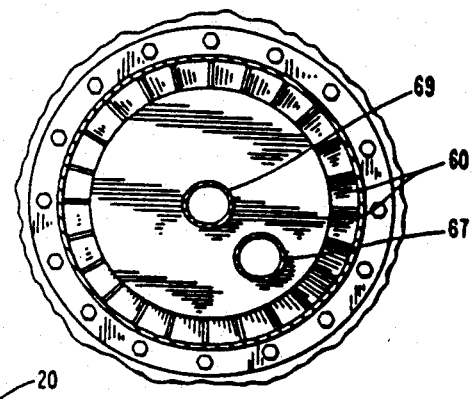
FIG. 4b.
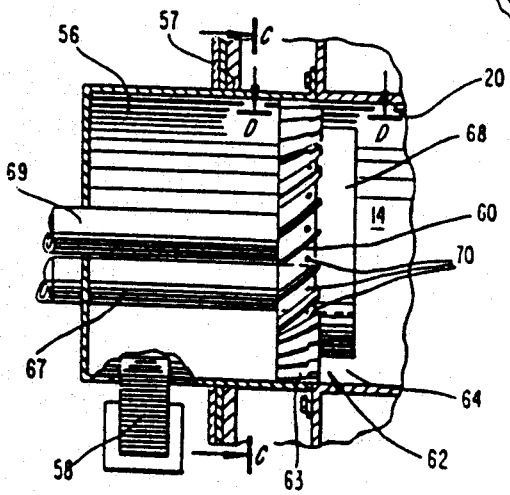

CYCLONE COMBUSTION APPARATUS

This is a continuation-in-part application of U.S. patent application Ser. No. 044,735 filed May 1, 1987, now U.S. Pat. No. 4,860,695.

BACKGROUND OF THE INVENTION

1. Field of the Invention

The present invention relates to a cyclonic combustion apparatus, and more particulary to a combustion apparatus that enables high specific heat release while producing exhaust gases with low concentrations of nitrogen oxide, commonly known as $NO_x$, and of other exhaust gases such as carbon monoxide (CO).

2. Description of the Related Art

In the past, cyclone combustion chambers have been used to produce a cyclone of turbulent gases within a combustion chamber for combusting various solid materials, including poor quality coal and vegetable refuse. Such combustors are disclosed in "Combustion and Swirling Flows: A Review", N. Syred and J. M. Beer, Combustion and Flame, Volume 23, pages 143-201 (1974). A fluidized bed boiler having a cyclonic combustor is disclosed in U.S. Pat. No. 4,457,289 to Korenberg. These documents are incorporated by reference in this application. A fire tube boiler having a cyclonic combustor was commercially marketed by Cyclotherm Division, Oswego Package Boiler Co., Inc.

Although known adiabatic cyclone combustors provide high specific heat release, such known combustors have the disadvantage that combustion temperature is high and $NO_x$ emissions are high. In conventional cyclone combustors, combustion is unstable at low capacity burning and high turndown ratios are not possible in non-adiabatic combustors.

The turndown ratio of a combustion apparatus in a boiler is defined as the ratio of maximum load to minimum load and measures the ability of the boiler to operate over the extremes of its load ranges. A high turndown ratio allows for a wide range in the level of steam generation at a particular time. A wide range of steam generation is important to allow the boiler to most efficiently respond to varying steam demands.

Stable combustion can be achieved by not cooling the walls of a cyclone combustion chamber in the portion of the chamber into which air and fuel are injected for combustion, as is disclosed in U.S. patent application Ser. No. 928,096, filed Nov. 7, 1986 and assigned to a common assignee, which is incorporated by reference in this application. High wall temperatures near the chamber fuel and air entrance enable a high turndown ratio to be achieved. For example, by incorporating uncooled refractory lined walls at the air and fuel entrance to the combustion chamber, the turndown ratio can be increased from 4:1 up to and higher than 10:1. With such an arrangement, excess air over that required as a combustion reactant, can be decreased from 25-30% to about 5% and kept constant at about 5% over the turndown ratio of 10:1. In addition the flame temperature can be decreased from 3000° F. for conventional fire tube boilers to about 2000° F. By lowering the excess air and by lowering the flame temperature, $NO_x$ emission concentrations are lowered in the flue exhaust.

With pollution control requirements becoming constantly more stringent, it is necessary to decrease $NO_x$ emissions even further than is achieved with the combustion apparatus described above, while not increasing or while even decreasing the cost of the combustion equipment.

It is an object of the present invention to provide a cyclone combustion apparatus having a very high specific heat release, that can operate at relatively low combustion temperatures and with a relatively low percentage of excess air to produce low carbon monoxide emissions, commonly known as CO, and very low $NO_x$ emissions.

It is also an object of the invention to provide a cyclone combustion apparatus that enables stable combustion and a high turndown ratio and that does not require refractory lined walls at the entrance of the combustion chamber.

It is another object of the present invention to provide a cyclone combustion apparatus capable of stable combustion at relatively low flame temperatures that may be produced at a reduced cost.

Additional objects and advantages of the invention will be set forth in the description which follows, and in part will be obvious from the description, or may be learned by practice of the invention. The objects and advanatages of the invention may be realized and obtained by means of the instrumentalities and combinations particularly pointed out in the appended claims.

SUMMARY OF THE INVENTION

To achieve the foregoing objects, and in accordance with the invention as embodied and broadly described herein, there is provided a cyclone combustion apparatus comprising a combustion chamber having a front end, a rear end and a substantially cylindrical wall having an inner surface; a substantially cylindrical exit throat at the rear end of the combustion chamber and aligned substantially concentrically therewith for exhausting hot gases from the combustion chamber, the exit throat having a diameter less than the diameter of the inner surface; means for supplying fuel into the combustion chamber from the front end thereof; means for supplying air into the combustion chamber and for forming a cyclonic flow pattern of hot gases for combustion within the chamber; and heat exchange means surrounding and extending substantially throughout the axial length of the combustion chamber for cooling the wall of the combustion chamber.

BRIEF DESCRIPTION OF THE DRAWINGS

The accompanying drawings, which are incorporated in and constitute a part of the specification, illustrate preferred embodiments of the invention and, together with the general description given above and detailed description of the preferred embodiments given below, serve to explain the principles of the invention.

FIG. 1(*a*) is a partial cross-sectional view of the annular air supply opening of the boiler illustrated in FIG. 1;

FIG. 4(*a*) is a broken away view in perspective of the front end of the boiler illustrated in FIG. 1;

FIG. 4(*b*) is a side elevational view of the front end of the boiler shown in FIG. 4(*a*);

FIG. 4(*c*) is a cross-sectional view taken along the line C—C of FIG. 4(*b*);

FIG. 4(*d*) is a partial cross-sectional view taken along the line D—D of FIG. 4(*b*);

DESCRIPTION OF THE PREFERRED EMBODIMENT

Figure 1:
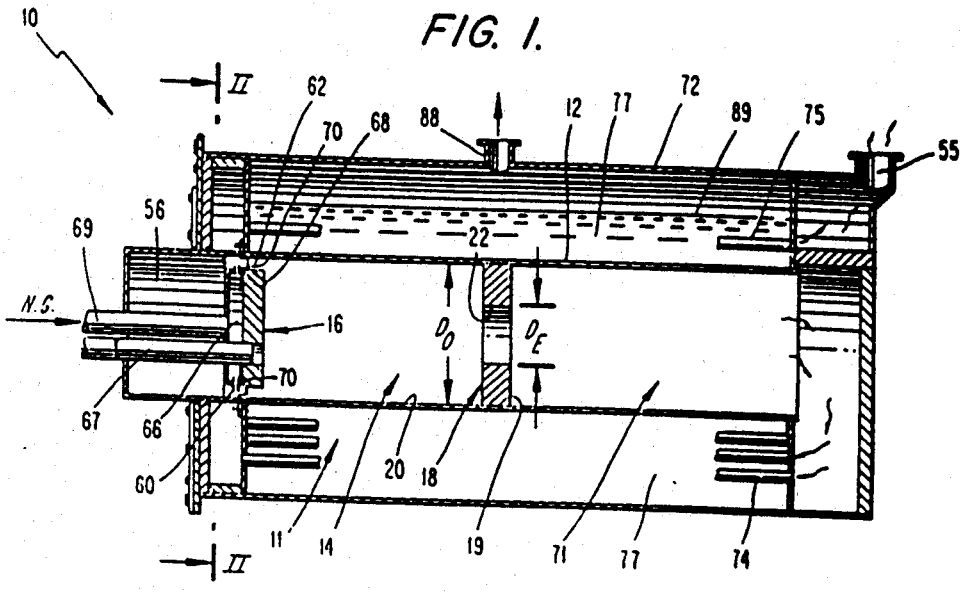
FIG. 1 is a side elevation in cross-section of a first embodiment of a fire tube boiler incorporating the teachings of the present invention.
Figure 1A:
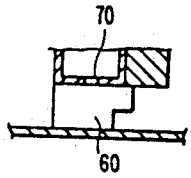

Reference will now be made in detail to the present preferred embodiments of the invention as illustrated in the accompanying drawings. Throughout the drawings, like reference characters are used to designate like elements.

In accordance with the invention, there is provided a cyclone combustion apparatus comprising a combustion chamber having a front end, a rear end and a substantially cylindrical wall having an inner surface; a substantially cylindrical exit throat at the rear end of the combustion chamber and aligned substantially concentrically therewith for exhausting hot gases from the combustion chamber, the exit throat having a diameter less than the diameter of the inner surface; means for supplying fuel directly into the combustion chamber from the front end thereof; means for supplying air into the combustion chamber and for forming a cyclonic flow pattern of hot gases for combustion within the chamber; and heat exchange means surrounding and extending substantially throughout the axial length of the combustion chamber for cooling the wall of the combustion chamber.

FIG. 1 shows a horizontally disposed fire tube boiler 10 having a cyclonic combustion apparatus 11 in accordance with one preferred embodiment of the invention. Apparatus 11 includes a central fire tube 12 also known as a Morison tube, with a combustion chamber 14. Chamber 14 includes a front end 16, a rear end 18 and a substantially cylindrical longitudinally extending outer wall 20.

A substantially cylindrical exit throat 22 in a rear end wall 19 is positioned at rear end 18 of combustion chamber 14 and is aligned substantially concentrically therewith for exhausting hot gases from combustion chamber 14. Exit throat 22 has a diameter less than the diameter of the inner surface of wall 20 of chamber 14. The ratio of the diameter of exit throat 22 (De) to the diameter of the inner surface of wall 20 of chamber 14 (Do), i.e., De/Do, is preferably within the range of about 0.4 to about 0.7 in order to achieve the desired cyclonic air flow within combustion chamber 14. Rear end wall 19 is preferably comprised of a refractory material.

In accordance with the present invention, means for supplying air into combustion chamber 14 and for forming a cyclonic flow pattern of hot gases for combustion within the chamber are provided. As embodied herein and as shown in FIG. 1, such means include an air plenum chamber 56, an annular air supply opening 62 and a plurality of spaced radial vanes 60. Air plenum chamber 56 is coaxially situated on front end 16 of combustion chamber 14. Air plenum 56 has an air inlet 58 (FIG. 3) which supplies air into plenum 56 and which is preferably tangentially aligned to plenum 56 in order to facilitate the air entrance into plenum 56 and minimize air pressure drop.

Plenum 56 communicates with annular air supply opening 62 and is preferably coaxially aligned with combustion chamber 14 as shown in FIGS. 4(*a*)-(*d*). Annular air supply opening 62 has an outer diameter that is substantially equal to the diameter of the inner surface of wall 20 of combustion chamber 14. As shown in FIG. 4(*b*), opening 62 includes a first annular segment 63 having an inner wall defined by a circumferential wall of a gas distribution plenum chamber 66 and having an outer wall defined by a portion of a wall 57 of air plenum chamber 56. Opening 62 further includes a second annular segment 64 having an inner wall defined by an outer circumferential surface of an end plate 68 at front end 16 of chamber 14 and having an outer wall defined by a portion of cylindrical wall 20 of chamber 14. The diameters of the inner and outer walls of first annular segment 63 and second annular segment 64 are substantially equal. A plurality of spaced radial vanes 60 are provided in first segment 63 of annular air supply opening 62. Radial vanes 60 are tilted a a selected angle $\theta$ from the normal axis of combustion chamber 14, as is best shown in FIGS. 4(*b*) and (*d*). Decreasing the selected angle between the vanes 60 and the normal axis of combustion chamber 14 has the effect of increasing the angular velocity, at a given combustion chamber cross-sectional area and air flow, of air entering combustion chamber 14 through annular ar supply opening 62. Angle $\theta$ is preferably in the range of about 20° to about 60°. Air entering combustion chamber 14 has a swirling flow pattern due to the selected angle $\theta$ of vanes 60 for generating swirling air in combustion chamber 14.

In accordance with the present invention, means for supplying fuel into the combustion chamber from the front end thereof are provided. As embodied herein, such means include a gas inlet pipe 69, gas distribution plenum chamber 66 and a plurality of gas distribution holes 70. Gas distribution plenum chamber 66 is provided on front end 16 of combustion chamber 14 between combustion chamber 14 and air plenum chamber 56. Gas inlet pipe 69 communicates with gas distribution plenum chamber 66 for supplying plenum chamber 66 with gas. As can best be seen in FIG. 1(*a*), a plurality of gas distribution holes 70 communicate gas distribution plenum chamber 66 with annular air supply opening 62. The plurality of holes 70, as shown in FIGS. 4(*a*), (*b*) and (*d*) supply gas to the first annular segment 63 of annular air supply opening 62. The location of gas holes 70 between vanes 60 results in low CO emissions, thus enabling a reduction in the excess air supplied to combustion chamber 14. With 15% excess air being supplied to combustion chamber 14, the CO emissions can be reduced close to zero with the present invention.

In addition to being capable of burning natural gas supplied through gas inlet pipe 69, each of the embodiments of the present invention is capable of efficiently combusting fuel oil. When fuel oil is combusted, it is supplied to the combustion chamber directly through pipe 67. Before the fuel oil is injected into the combustion chamber it must be properly atomized to provide for complete smokeless combustion. Appropriate methods for atomizing fuel oil are well known to those skilled in the combustion art. Such methods include the use of state-of-the-art nozzle designs and utilizing high oil pressures (up to 400 psig).

In addition to providing a means for injecting fuel oil into the combustion chamber, pipe 67 can also be used as a means for supplying a separate stream of air into the combustion chamber. If natural gas is being combusted, the air entering plenum chamber 56 can be supplied to achieve sub-stoichiometric combustion in annular air supply opening 62. A separate stream of air can be provided through pipe 67 to achieve abovestoichiometric combustion in the combustion chamber. Such air staging will result in reduced $NO_x$ emissions. To further reduce $NO_x$ emissions, steam can be injected through pipe 67.

When fuel oil is being supplied through pipe 67 for combustion in chamber 14, a separate stream of air may also be provided in pipe 67. This air stream performs a dual function; namely, it cools the oil nozzles (not shown) in pipe 67 and can be utilized for staged combustion as discussed earlier.

Combustion chamber 14, exit throat 22, annular air supply opening 62 and vanes 60 are dimensioned and configured to effect a cyclonic flow pattern of hot gases for combustion within combustion chamber 14, having a Swirl Number [defined in terms of combustor input and exit parameters as S = (Input Axial Flux of Angular Momentum)/(De/2 x Exit Axial Flux of Linear Momentum), where De is the combustor exit throat diameter]of at least 0.6 and a Reynolds Number of at least 18,000 when the chamber is operated at full capacity. Chamber 14 will, during operation, exhibit large internal reverse flow zones with at least three concentric toroidal recirculation zones being formed. Such recirculation zones are known generally in the field of conventional cyclone combustors. It is the cyclone turbulence which enables the achievement of specific heat release values up to and higher than $3.5\times10^6$ Kcal per cubic meter per hour and that contributes to reduced $NO_x$ concentrations in the flue gases. This coupled with the high level of turbulence results in significantly improved heat exchange and, therefore a relatively uniform temperature throughout combustion chamber 14.

The gas supplied through gas plenum chamber 66 and the air supplied through air plenum chamber 56 initially mix in the region between vanes 60 in annular air supply opening 62. This fuel/air mixture is ignited by a flame provided by a pilot (not shown). The pilot is a gas-fired pilot wherein the pilot burner fuel and air are ignited by means of an electric spark supplied by an electrode. In addition to igniting the air/fuel mixture, the pilot can assist in maintaining a stable flame in the combustion chamber. The size of the pilot varies depending on the size of the combustion chamber. The configuration of such a pilot is well known to those skilled in the combustion art.

Depending on the turndown ratio desired for the boiler, the flame provided by the pilot may not always be necessary after start-up For instance, at a high turndown ratio, i.e., 10:1, it may be necessary to maintain a constant pilot at a low boiler rate, whereas a lower turndown ratio may enable the pilot to be shut down after start-up.

Figure 5:
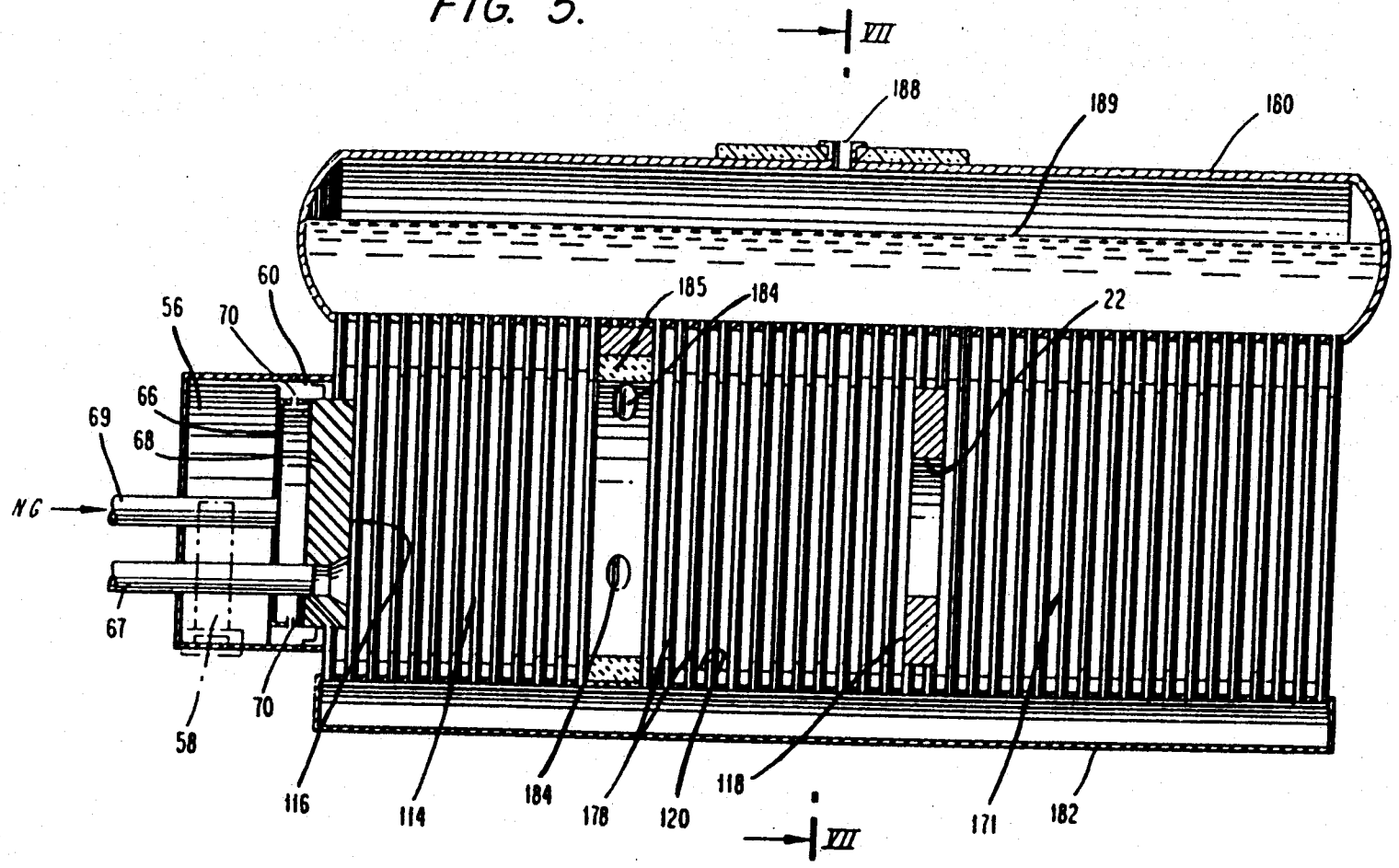
FIG. 5 is a side elevation in cross-section of a second embodiment of a boiler incorporating the teachings of the present invention.

In accordance with the present invention, heat exchange means surround and extend substantially throughout the axial length of combustion chamber 14 for cooling the wall of the combustion chamber. As embodied herein, such means comprise water contained in the water jacket (shell) of a fire tube boiler, as shown in FIG. 1, water contained in the tubes of a water tube boiler, as shown in FIG. 5, or one of the other boiler heat exchange embodiments shown in FIGS. 8, 9 and 11. The features of these boiler embodiments will be explained in greater detail below. The heat exchange means cool cylindrical outer wall 20 of combustion chamber 14.

In combustion chamber 14, stable combustion is achieved over a broad range of boiler operating capacities including a very low capacity, because of the thorough mixing of gas and air between vanes 60 and throughout combustion chamber 14. Additionally, the presence of refractory end plate 68 in the front end 16 of combustion chamber 14 contributes to stable combustion. The pilot can be extinguished once end plate 68 is sufficiently heated.

The cooling effect of the heat exchange means on combustion chamber 14 keeps the operating flame temperature within the combustion chamber lower than that in conventional cyclonic combustion chambers, and preferably at a temperature less than 2000° F. throughout its range of capacity, including when the cyclone combustion chamber is operated at maximum capacity. Because of this reduced temperature, $NO_x$ emissions exhausted from combustion chamber 14 can be reduced to a point where $NO_x$ formulation is lower than 50 ppm calculated down or up to 3% oxygen in flue gases. That is, if combustion was performed at 3.5% oxygen, for instance, the percent would be calculated "down"; if the same at 2.5%, then the percent would be calculated "up". In addition, combustion chamber 14 is entirely cooled by the heat exchange means and combustion chamber 14 does not have refractory material. Therefore, the capital costs of chamber 14 are substantially reduced from that of a conventional cyclonic burner.

According to a preferred embodiment of the invention, a substantially cylindrical cooling chamber extends axially beyond the exit throat from the rear end of the combustion chamber and is substantially longitudinally aligned with the combustion chamber. As embodied herein, a cooling chamber 71 extends from rear end 18 of combustion chamber 14. Outer cylindrical wall 20 of combustion chamber 14 and cooling chamber 71 together form the Morison tube 12 of the boiler embodiment shown in FIG. 1. Cooling chamber 71 is cooled by the heat exchange means in the same manner as combustion chamber 14 is cooled.

Figure 2:
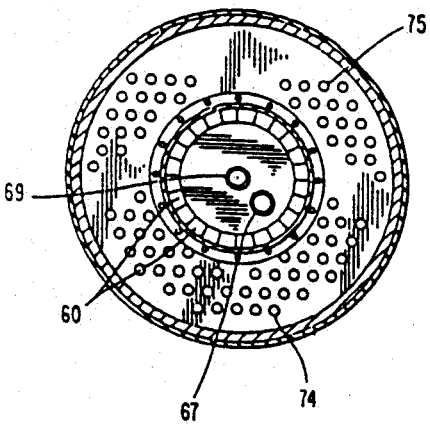
FIG. 2 is a cross-section view taken along the line II—II of FIG. 1.
Figure 3:
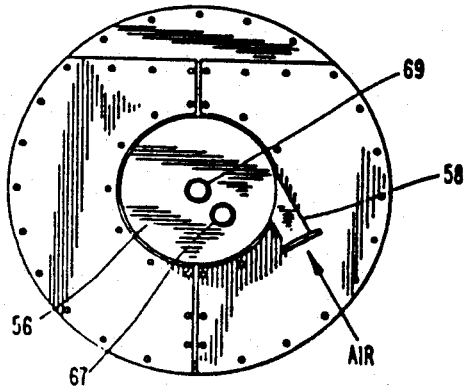
FIG. 3 is a front end view of the boiler illustrated in FIG. 1.

In a preferred embodiment of the invention shown in FIGS. 1–3, the heat exchange means surrounding and extending substantially throughout the axial length of the combustion chamber for cooling the wall of the combustion chamber comprise a portion of a fire tube boiler. The fire tube boiler includes an outer boiler shell 72, and gas tubes 74 and 75 between outer shell 72 and Morison tube 12. A space 77 within shell 72, outside gas tubes 74, 75 and Morison tube 12 is filled with cooling fluid, typically water, to a fluid level 89. Cooling fluid in space 77 cools cylindrical outer wall 20 of combustion chamber 14 and the outer wall of cooling chamber 71. Steam is exhausted from space 77 through port 88.

Cooling of the combustion chamber decreases combustion flame temperature below 2000° F., as opposed to 3000° F. for conventional fire tube boilers. Because of this lowered temperature and because excess air in combustion chamber 14 can be decreased to 5%, from 25-30% for conventional boilers, and can be kept constant over a high uniform turndown ratio of 10:1, $NO_x$ emissions are lower than is normally the case with standard fire tube boilers and the $NO_x$ emissions reduction from boilers equipped with known cyclonic combustors is even greater.

First plurality of gas tubes 74 and a second plurality of gas tubes 75 extend parallel to the axis of Morison tube 12. First plurality of gas tubes 74 are in communication at one end with an end of cooling chamber 71 and at the opposite end with one end of second plurality of gas tubes 75 that are in turn in communcation at their opposite ends with an exhaust flue 55 that exhausts gases from tubes 75. The arrows in FIG. 1 indicate the direction of gas flow, as is conventionally known for fire tube boilers.

In the preferred embodiment of the present invention, there is further provided means for supplying steam into air plenum chamber 56, gas plenum chamber 66, or combustion chamber 14 to further reduce the concentration of $NO_x$ in the exhaust gas below 50 ppm. In the first embodiment of the invention, a portion of the steam exiting through port 88 can be transported via a steam line (not shown) to either of plenum chambers 56 or 66 or directly into chamber 14 as a means of reducing $NO_x$. The use of steam injection in the present invention has resulted in $NO_x$ emissions below 20 ppm without adversely affecting boiler stability and with minimal adverse effect on boiler efficiency.

Experiments conducted thus far show that it is preferable to inject the steam into the gas plenum 66. The stability of the combustion is excellent and the amount of steam required to significantly decrease $NO_x$ emissions is low. For example, it is believed that less than 5 lbs. of steam per 100 cubic feet of gas are required to significantly reduce $NO_x$. The specific amount of steam utilized depends on the desired concentration of $NO_x$ in the exhaust gases.

Figure 6:
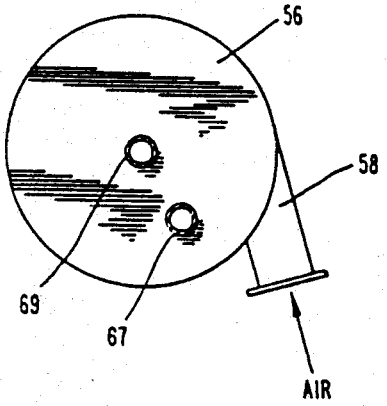
FIG. 6 is a front end view of the boiler illustrated in FIG. 5.
Figure 7:
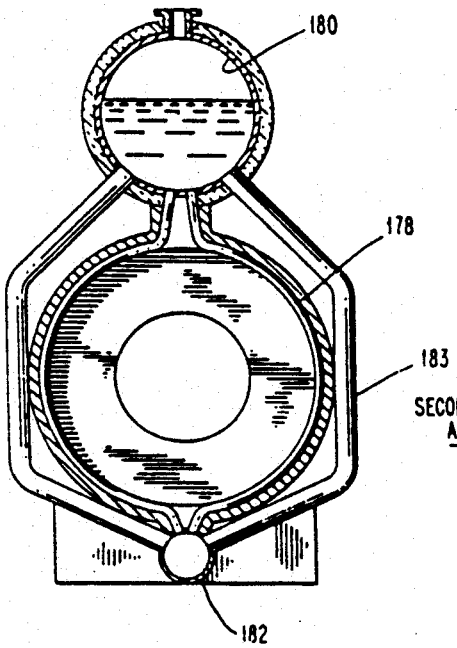
FIG. 7 is a cross-sectional view taken along the line VII—VII of FIG. 5.

According to another embodiment of the invention, the heat exchange means surrounding and extending substantially throughout the axial length of the combustion chamber for substantially cooling the wall of the combustion chamber may comprise a portion of a water tube boiler, as shown in FIGS. 5-7. The water tube boiler is useful because it allows for cyclonic combustion at pressures and boiler capacities greater than can be achieved with fire tube boilers. With increased boiler pressure and capacity in a fire tube boiler, Morison tube 12 experiences an elevation of metal wall skin temperature. This can result in metal stress fatigue that can eventually lead to destruction of the boiler. Accordingly, it may be useful to utilize a water tube boiler as a heat exchange means in the cyclone combustion apparatus described above when it is required to design a boiler for high pressure or capacity, or both.

The water tube boiler shown in FIG. 5 includes a cyclone combustion apparatus like the one described above having a cyclone combustion chamber 114 and a cooling chamber 171 on rear end 118 of combustion chamber 114. Combustion chamber 114 and cooling chamber 171 have walls formed from a plurality of cooling tubes 178 extending throughout the axial lengths of combustion chamber 114 and cooling chamber 171. Cooling tubes 178 may be either contiguously joined or spaced from and connected to each other by metal fins to form a continuous wall. Tubes 178 are connected between a steam drum 180, longitudinally extending parallel to and above combustion chamber 114 and cooling chamber 171, and a header 182, longitudinally extending parallel to and below combustion chamber 114 and cooling chamber 171. Steam drum 180 and header 182 are also connected by recirculation tubes 183 which recirculate cooling fluid from steam drum 180 to header 182 (FIG. 7).

In operation, cooling tubes 178 are filled with cooled fluid for absorbing heat from combustion chamber 114 and cooling chamber 171. When the cooling fluid absorbs heat, saturated steam is generated which rises into steam drum 180 above a cooling fluid level 189. Steam is exhausted through port 188. Exhaust gases from the outlet of cooling chamber 171 may be transmitted to a convective tube bank which could comprise, for instance, a superheater and economizer, as it conventionally known in the art, for removing heat from the exhaust gases. A portion of the steam exhausted through port 188 may be recirculated and supplied into combustion chamber 14 to reduce $NO_x$ emissions.

According to one embodiment of the invention, secondary air inlets 184 may be provided in combustion chamber 114. Secondary air inlets 184 are tangentially aligned with the inner surface of wall 120 of chamber 114 for providing additional cyclonic swirling action within cyclonic combustion chamber 114. As shown in FIG. 5, secondary air inlets 184 are formed between two groups of cooling tubes 178 in a circumferential portion 185. Portion 185 is preferably formed of a refractory material because cooling tubes do not pass through portion 185.

Supplying secondary air to combustion chamber 114 allows for greater control of combustion within combustion chamber 114. Further, because secondary air inlets 184 are axially spaced from front end 116 of combustion chamber 114, excess air in the front end of combustion chamber 114 can be reduced because air for combustion in the rear end of chamber 114 is supplied by secondary air inlets 184. With this arrangement, primary and secondary air supplies can be controlled relative to the fuel supply so that combustion in the front end of combustion chamber 114 takes place at sub-stoichiometric conditions. Downstream of secondary air inlets 184, combustion will be above stoichiometric combustion conditions and reverse flows in combustion chamber 114 will also be above stoichiometric combustion conditions. Thus, combustion in the front portion of combustion chamber 114 is substoichiometric and temperatures are reduced due to cooling of cylindrical wall 120 of combustion chamber 114 by cooling tubes 178 so that $NO_x$ production is kept low.

Figure 8:
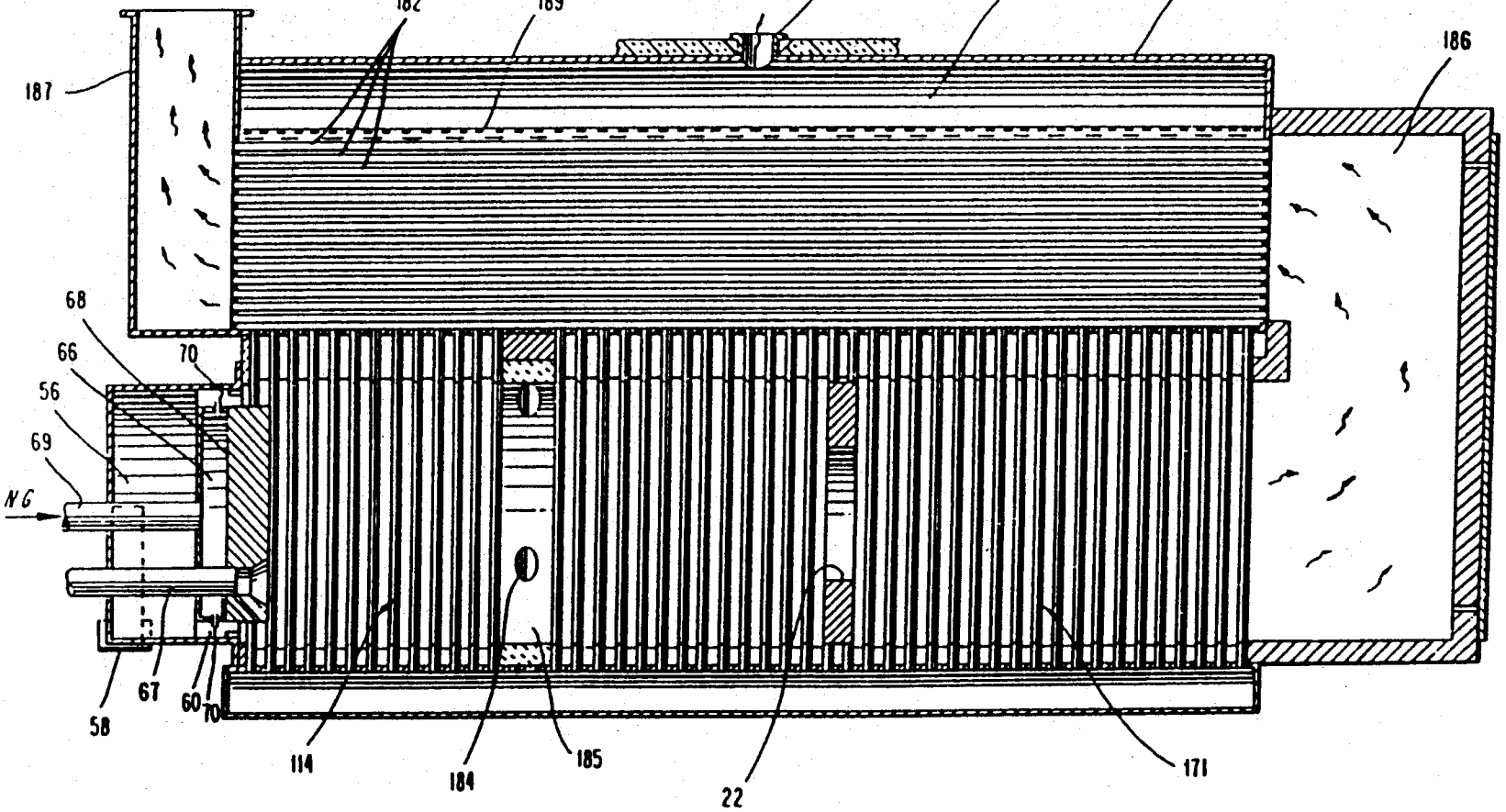
FIG. 8 is a side elevation in cross-section of a third embodiment of a boiler incorporating the teachings of the present invention.

According to another embodiment of the invention, the apparatus shown in FIGS. 5-7 can be modified, as shown in FIG. 8, by including a plurality of spaced gas tubes 182 in an interior portion 181 of steam drum 180. Gas tubes 182 extend along the axial length of steam drum 180 for conducting hot gases from cooling chamber 171 through a turn box 186 and out through a gas exhaust flue 187, as shown by the arrows in FIG. 8. Gas tubes 182 are below cooling fluid level 189 so as to be surrounded by cooling fluid inside steam drum 180.

Steam in steam drum 180 above cooling fluid level 189 is exhausted through port 188.

Figure 10:
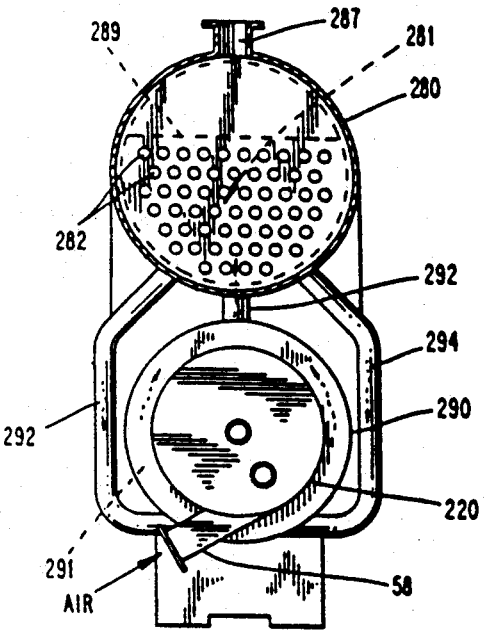
FIG. 10 is a cross-sectional view taken along the line X—X of FIG. 9.
Figure 9:
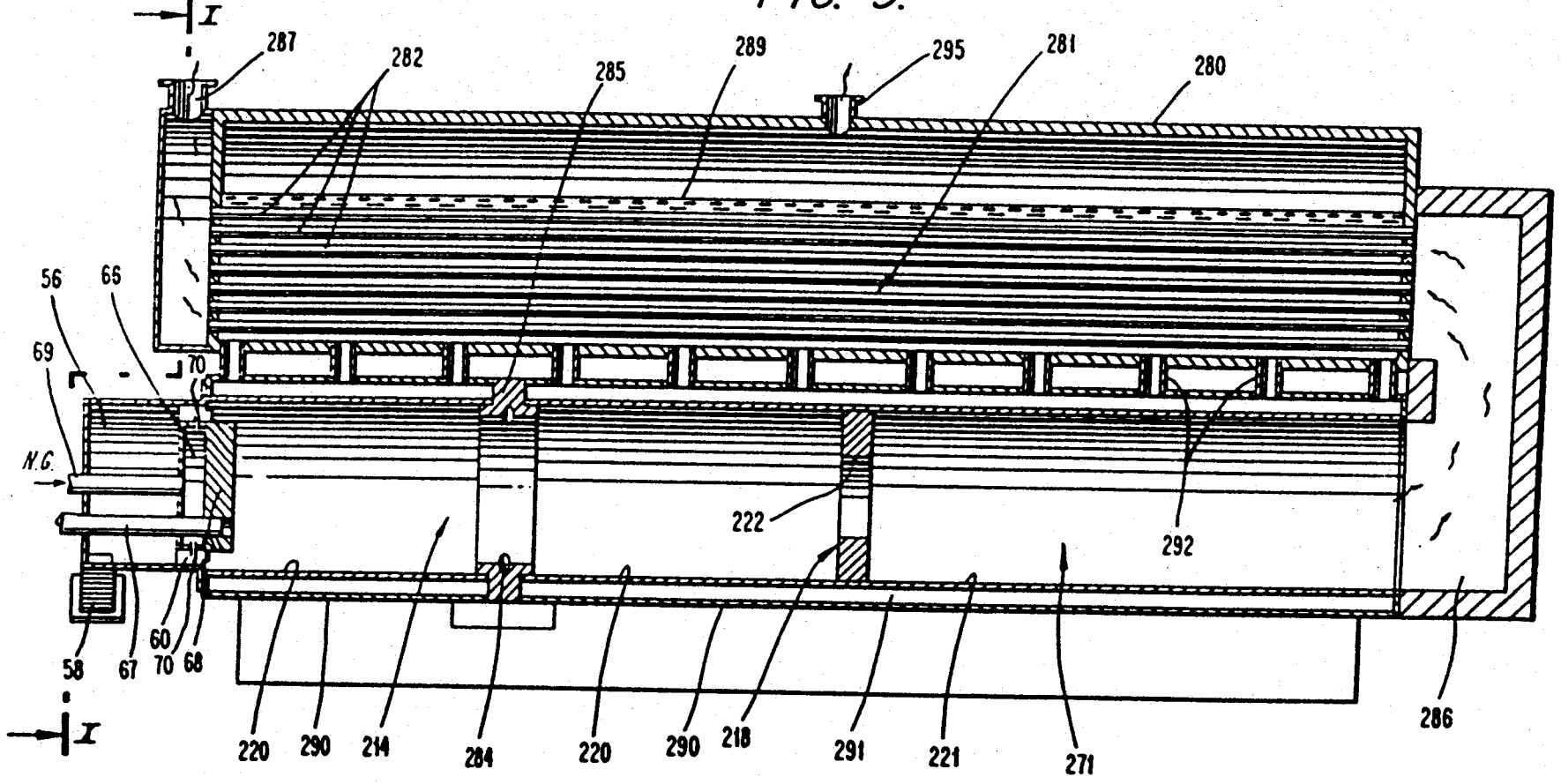
FIG. 9 is a side elevation in cross-section of a fourth embodiment of a boiler incorporating the teachings of the present invention.

According to another embodiment of the invention, the heat exchange means surrounding and extending substantially throughout the axial length of the combustion chamber for substantially cooling the wall of the combustion chamber may comprise a portion of a boiler, as shown in FIGS. 9–12. The boiler shown in FIG. 9 includes a cyclone combustion apparatus like the one described above, having a cyclone combustion chamber 214 and a cooling chamber 271 extending from rear end 218 of combustion chamber 214. Combustion chamber 214 and cooling chamber 271 have cylindrical walls 220 and 221, respectively. A jacket 290 is spaced from and surrounds cylindrical walls 220 and 221. The space between jacket 290 and walls 220, 221 defines an annular cooling chamber 291 that is filled with cooling fluid for absorbing heat from the walls of combustion chamber 214 and cooling chamber 271. A plurality of connecting risers 292 connect an interior portion 281 of a steam drum 280 with annular cooling chamber 291. In FIGS. 9–10, recirculation downcomers 294 are shown that connect steam drum 280 and annular cooling chamber 291 along the length of combustion chamber 214 and cooling chamber 271. Heated fluid and steam formed in annular cooling chamber 291 rise into interior portion 281 of steam drum 280 through risers 292. Cooling fluid recirculates through recirculation downcomers 294 into the base of annular cooling chamber 291. Steam above cooling fluid level 289 is exhausted from steam drum 280 through exhaust port 295. This boiler is best utilized when the boiler is to operate at medium to low pressures or capacities, or both.

As was described with respect to the embodiment shown in FIG. 8, the embodiment shown in FIG. 9 includes a plurality of gas tubes 282 extending through the vertical length of interior portion 281 of steam drum 280. Gas tubes 282 function in the same manner as gas tubes 182 of FIG. 8. The embodiment shown in FIG. 9 also includes secondary air inlets 284 in a circumferential portion 285 that function like the secondary air inlets 184 of FIG. 5.

Figure 12:
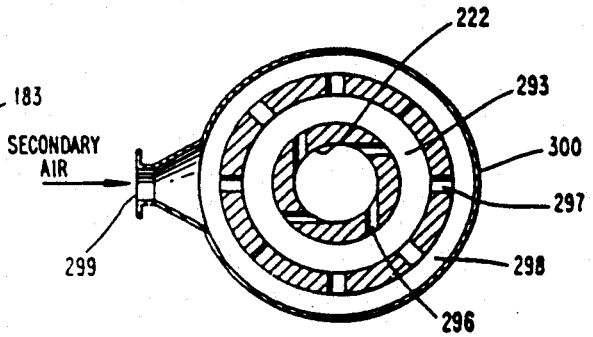
FIG. 12 is a cross-section view taken along the line XII—XII of FIG. 11.
Figure 11:
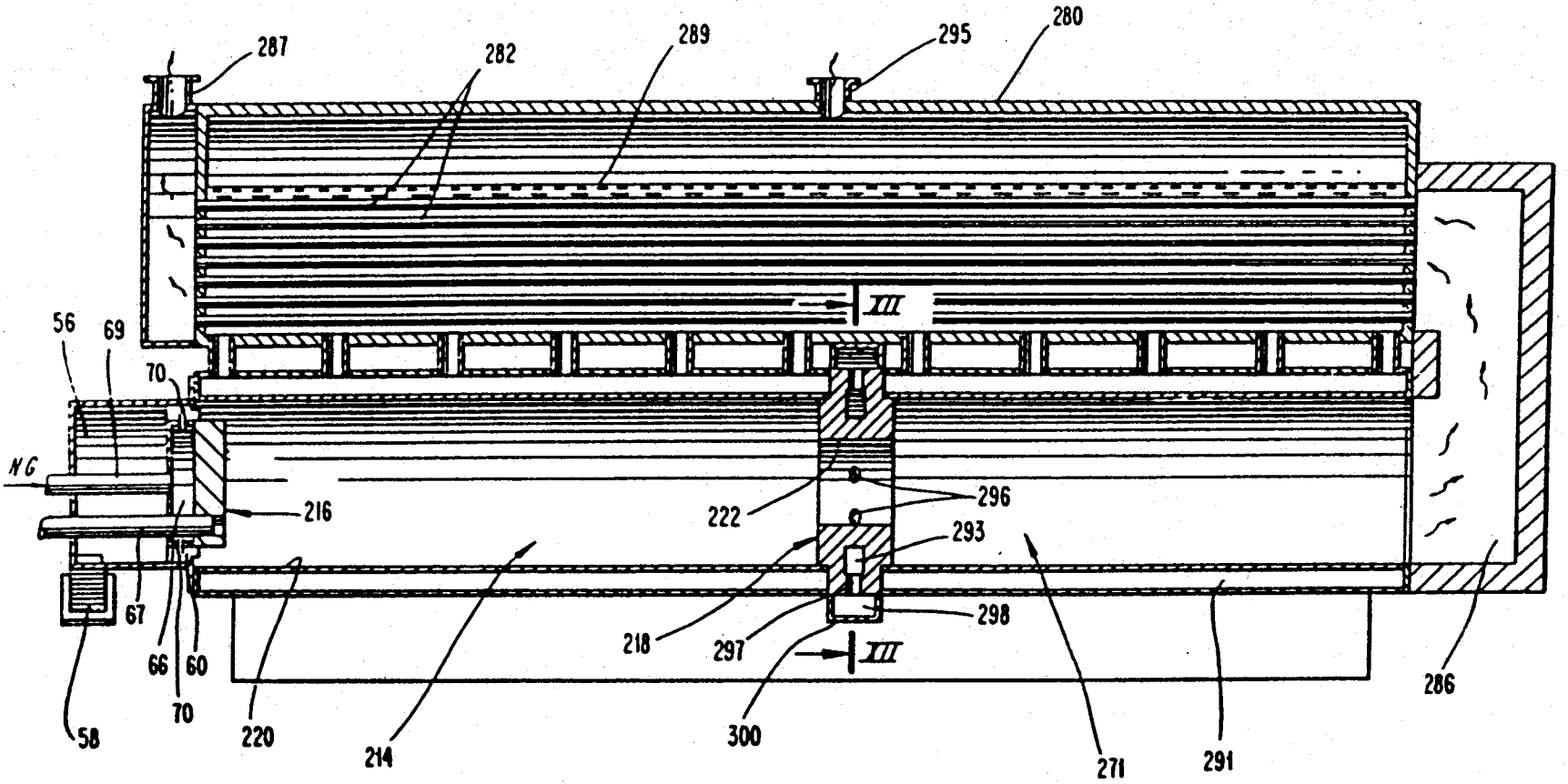
FIG. 11 is a side elevation in cross-section of a fifth embodiment of a boiler incorporating the teachings of the present invention.

The boiler of FIG. 9 may be modified as shown in FIGS. 11 and 12. According to the embodiment of the invention shown in FIG. 11, the apparatus is provided with secondary air inlets 296 in exit throat 222 for supplying secondary air to exit throat 222. As shown in FIG. 12, secondary air enters secondary air chamber 300 through inlet 299 into a first manifold 298. The secondary air then passes through ports 297 into a second manifold 293 from which the secondary air enters throat 222 through tangential air inlets 296.

By introducing secondary air at exit throat 222, combustion in the entire combustion chamber 214 can be performed at substoichiometric combustion conditions and relatively lower temperatures. Thus, the amount of $NO_x$ produced in combustion chamber 214 is reduced. In addition, by tangentially introducing secondary air into exit throat 222, rotational flow in cooling chamber 271 is increased so that gas velocities along the walls of cooling chamber 271 are also increased causing an increased heat transfer. This increased tangential momentum of the exhaust gases in cooling chamber 271 increases heat transfer to annular cooling chamber 291. With increased heat transfer, gas being exhausted from cooling chamber 271 have a decreased temperature which decreases $NO_x$ emissions.

Tangential air inlets in the exit throat for supplying secondary air, as described above, can also be advantageously applied to the boiler embodiments shown in FIGS. 5 and 8. Staging air in the manner described with respect to the embodiment shown in FIG. 11 can similarly reduce $NO_x$ emissions in the embodiments shown in FIGS. 5 and 8.

It will be apparent to those skilled in the art that modifications and variations can be made in the cyclonic combustion apparatus of this invention. The invention in its broader aspects is, therefore, not limited to the specific details, representative apparatus, and illustrative examples shown and described above. Thus, it is intended that all matter contained in the foregoing description or shown in the accompanying drawings shall be interpreted as illustrative and not in a limiting sense.

What is claimed is:

1. A cyclone combustion apparatus comprising:

a combustion chamber having a front end, a rear end and a substantially cylindrical wall having an inner surface;

a substantially cylindrical exit throat at the rear end of the combustion chamber and aligned substantially concentrically therewith, for exhausting hot gases from the combustion chamber, the exit throat having a diameter less than the diameter of said inner surface;

means for supplying fuel into said combustion chamber, said fuel supplying means including a fuel plenum chamber having a fuel inlet and a plurality of radially spaced fuel holes;

means for supplying air into said combustion chamber and for forming a cyclonic flow pattern of hot gases for combustion within said chamber, said air supplying means including an air plenum chamber fixed on the front end of the combustion chamber, said air plenum chamber having an air inlet and an annular air supply opening in communication with and coaxial with the combustion chamber, said annular air supply opening having spaced radial vanes tilted at a selected angle from the axis of said combustion chamber to effect cyclonic air swirling in the combustion chamber, the fuel holes supplying fuel in the annular air supply opening between the spaced radial vanes; and heat exchange means surrounding and extending substantially throughout the axial length of the combustion chamber for cooling the wall of said combustion chamber.

2. The apparatus of claim 1, wherein the selected angle is from about 20° to about 60°.

3. The apparatus of claim 2, wherein the air inlet of the air plenum chamber is substantially tangential to said plenum chamber and the annular air supply opening has an outer diameter substantially equal to the diameter of the inner surface of the combustion chamber wall.

4. The apparatus of claim 3 further comprising a substantially cylindrical cooling chamber extending axially beyond the exit throat from the rear end of the combustion chamber and substantially longitudinally aligned with the combustion chamber.

5. The apparatus of claim 1, wherein the combustion chamber, the exit throat and the annular air supply opening are dimensioned and configured to effect a cyclonic flow pattern in the combustion chamber having a Swirl number of at least 0.6 and a Reynolds number of at least 18,000.

6. The apparatus of claim 1, wherein the heat exchange means is operative to provide a flame temperature in the combustion chamber that is less than about 2000° F.

7. The apparatus of claim 1 further comprising a secondary tangential air inlet in the wall of the combustion chamber intermediate its ends for supplying secondary air into said combustion chamber.

8. The apparatus of claim 1 further comprising means for supplying steam into the combustion chamber for reducing the concentration of $NO_x$.

9. A cyclone combustion apparatus for a firetube boiler, comprising:

a combustion chamber having a front end, a rear end and a substantially cylindrical longitudinally extending wall having an inner surface, the combustion chamber comprising a portion of the boiler firetube;

means for supplying fuel into the combustion chamber from the front end thereof, said fuel supplying means including a fuel plenum chamber having a fuel inlet and a plurality of radially spaced fuel holes;

means for supplying air into the combustion chamber and for forming a cyclonic flow pattern of hot gases for combustion within said chamber, said air supplying means including an air plenum chamber fixed on the front end of the combustion chamber, said air plenum chamber having an air inlet and an annular air supply opening in communication with and coaxial with the combustion chamber, said annular air supply opening having spaced radial vanes tilted at a selected angle from the axis of said combustion chamber to effect cyclonic air swirling in the combustion chamber, the fuel holes supplying fuel in the annular air supply opening between the spaced radial vanes;

a substantially cylindrical exit throat at the rear end of the combustion chamber and aligned substantially concentrically therewith for exhausting hot gases from the combustion chamber, the exit throat having a diameter less than the diameter of the inner surface of the chamber wall; and heat exchange means surrounding and extending substantially throughout the axial length of the combustion chamber for cooling the wall of the combustion chamber and for absorbing heat from the hot gases exhausted from said exit throat, the heat exchange means including an outer shell surrounding said combustion chamber, a plurality of spaced gas tubes disposed between said outer shell and the combustion chamber for conducting hot gases from the combustion chamber and a space within the shell exterior of the gas tubes and the combustion chamber for containing a cooling fluid.

10. The apparatus of claim 9 including a substantially cylindrical cooling chamber extending axially beyond the exit throat from the rear of the combustion chamber and substantially longitudinally aligned with the combustion chamber, said exhaust portion also being surrounded by said outer shell, said plurality of spaced gas tubes and said space for containing cooling fluid.

11. The apparatus of claim 10 wherein the plurality of gas tubes includes a first and second plurality of gas tubes extending parallel to the axis of said combustion chamber, said first plurality of gas tubes being in communication at one end with an end of the exhaust portion and at the opposite end with one end of the second plurality of tubes, said second plurality being in communication at the other end with an exhaust flue for exhausting the gases within the tubes.

12. The apparatus of claim 10 wherein said plurality of gas tubes extend parallel to the axis of said combustion chamber, said plurality of gas tubes being in communication at one end with an end of the cooling chamber and at the other end with an exhaust flue for exhausting the gases within the tubes.

13. The apparatus of claim 10 wherein the heat exchange means includes means for directing the flow of hot gases from the cylindrical cooling chamber through the gas tubes.

14. The apparatus of claim 13 wherein the gas tubes of the heat exchange means longitudinally extend parallel to the axes of the combustion chamber and the substantially cylindrical cooling chamber.

15. The apparatus of claim 9 further comprising means for supplying steam into the combustion chamber for reducing the concentration of $NO_x$.

16. A cyclone combustion apparatus for a water tube boiler comprising:

a combustion chamber having a front end, a rear end and a substantially cylindrical longitudinally extending wall having an inner surface, said combustion chamber comprising a portion of the boiler water tube;

means for supplying fuel into said combustion chamber from the front end thereof, said fuel supplying means including a fuel plenum chamber having a fuel inlet and a plurality of radially spaced fuel holes;

means for supplying air into said combustion chamber and for forming a cyclonic flow pattern of hot games for combustion within said combustion chamber, said air supplying means including an air plenum chamber fixed on the front end of the combustion chamber, said air plenum chamber having an air inlet and an annular air supply opening in communication with and coaxial with the combustion chamber, said annular air supply opening having spaced radial vanes tilted at a selected angle from the axis of said combustion chamber to effect cyclonic air swirling in the combustion chamber, the fuel holes supplying fuel in the annular air supply opening between the spaced radial vanes;

a substantially cylindrical exit throat at the rear end of the combustion chamber and aligned substantially concentrically therewith for exhausting hot gases from the combustion chamber, the exit throat having a diameter less than the diameter of the inner surface of the combustion chamber wall;

heat exchange means surrounding and extending substantially throughout the axial length of the combustion chamber for cooling the wall of the combustion chamber, the heat exchange means including a steam drum longitudinally extending parallel to and above said combustion chamber, a header longitudinally extending parallel to and below said combustion chamber, a plurality of tubes connecting said header and steam drum, said tubes being integral with said combustion chamber wall along the length of said combustion chamber on opposite sides of said chamber, said tubes filled with cooling fluid for absorbing heat from said chamber to produce steam that is exhausted from said steam drum.

17. The apparatus of claim 16 including a substantially cylindrical cooling chamber extending from the rear of the combustion chamber and substantially longitudinally aligned with the combustion chamber.

18. The apparatus of claim 17 wherein the steam drum, the header and the plurality of connecting tubes extend throughout the axial length of the combustion chamber and the substantially aligned cylindrical cooling chamber, and said tubes contiguously form the walls of said combustion chamber and of said substantially cylindrical cooling chamber for absorbing heat from said combustion chamber and cooling chamber.

19. The apparatus of claim 17 wherein the steam drum, the header and the plurality of semicircular connecting tubes extend throughout the axial length of the combustion chamber and the substantially aligned cylindrical cooling chamber, and the tubes are spaced from or close to each other and integral with the combustion chamber wall and cooling chamber wall for absorbing heat therefrom.

20. The apparatus of claim 18 further comprising a plurality of spaced gas tubes extending in an interior portion of the steam drum along the axial length of the steam drum for conducting hot gases from the exhaust portion, said gas tubes being surrounded by cooling fluid and steam in said steam drum, said gas tubes each having a first end in communication with an end of the exhaust portion and having an opposite second end in communication with an exhaust flue for exhausting the gases within the gas tubes.

21. The apparatus of claim 17 further comprising a secondary air inlet in the wall of said combustion chamber intermediate said front and rear ends for supplying secondary air to said combustion chamber.

22. The apparatus of claim 16 further comprising means for supplying steam into the combustion chamber for reducing the concentration of $NO_x$.

23. A cyclone combustion apparatus for a boiler comprising:

a combustion chamber having a front end, a rear end and a substantially cylindrical longitudinally extending wall having an inner and an outer surface, said combustion chamber comprising a portion of the boiler;

means for supplying fuel into said combustion chamber from the front end thereof, said fuel supplying means including a fuel plenum chamber having a fuel inlet and a plurality of radially spaced fuel holes;

means for supplying air into said combustion chamber and for forming a cyclonic flow pattern of hot gases for combustion within said combustion chamber, said air supplying means including an air plenum chamber fixed on the front end of the combustion chamber, said air plenum chamber having an air inlet and an annular air supply opening in communication with and coaxial with the combustion chamber, said annular air supply opening having spaced radial vanes tilted at a selected angle from the axis of said combustion chamber to effect cyclonic air swirling in the combustion chamber, the fuel holes supplying fuel in the annular air supply opening between the spaced radial vanes;

a substantially cylindrical exit throat at the rear end of the combustion chamber and aligned substantially concentrically therewith for exhausting hot gases from the combustion chamber, the exit throat having a diameter less than the diameter of the inner surface of the combustion chamber wall;

heat exchange means surrounding and extending substantially throughout the axial length of the combustion chamber for cooling the wall of the combustion chamber, the heat exchange means including a steam drum longitudinally extending parallel to and above said combustion chamber, a jacket spaced from and surrounding said combustion chamber wall, said jacket and combustion chamber wall defining an annular cooling chamber filled with cooling fluid for absorbing heat from said chamber, a plurality of connecting pipes connecting said steam drum with said annular cooling chamber, said connecting pipes spaced from each other above and along the axial length of said combustion chamber, and a plurality of recirculating pipes connecting said steam drum with said annular cooling chamber at said combustion chamber bottom.

24. The apparatus of claim 23 including a substantially cylindrical cooling chamber extending from the rear of the combustion chamber and substantially longitudinally aligned with the combustion chamber.

25. The apparatus of claim 24 wherein said steam drum, said jacket and said connecting pipes extend throughout the axial length of said combustion chamber and said substantially aligned cylindrical cooling chamber for absorbing heat therefrom.

26. The apparatus of claim 25 further comprising a tangential air inlet in said exit throat for supplying secondary air to said exit throat.

27. The apparatus of claim 25 further comprising a secondary air inlet in the wall of said combustion chamber intermediate said front and rear ends for supplying secondary air to said combustion chamber.

28. The apparatus of claim 23 further comprising means for supplying steam into the combustion chamber for reducing the concentration of $NO_x$.

* * * * *

UNITED STATES PATENT AND TRADEMARK OFFICE

CERTIFICATE OF CORRECTION

PATENT NO. : 5,029,557

DATED : JULY 9, 1991

INVENTOR(S) : JACOB KORENBERG

It is certified that error appears in the above-identified patent and that said Letters Patent is hereby corrected as shown below:

Claim 16, column 12, line 35, "games" should be --gases--.

Signed and Sealed this

Sixth Day of October, 1992

*Attest:*

DOUGLAS B. COMER

*Attesting Officer*

*Acting Commissioner of Patents and Trademarks*